United States Patent [19]

Hayes

[11] Patent Number: 5,031,238

[45] **Date of Patent: * Jul. 16, 1991**

[54] BASEBALL GLOVES AND ATTACHMENTS THEREFOR, AND METHODS OF CONSTRUCTING AND UTILIZING SAME

[76] Inventor: Rufus Hayes, 18640 Griggs, Detroit, Mich. 48221

[ * ] Notice: The portion of the term of this patent subsequent to Jan. 9, 2007 has been disclaimed.

[21] Appl. No.: 498,898

[22] Filed: Mar. 26, 1990

Related U.S. Application Data

[63] Continuation-in-part of Ser. No. 275,951, Nov. 25, 1988, Pat. No. 4,937,882, which is a continuation-in-part of Ser. No. 158,647, Feb. 22, 1988, Pat. No. 4,891,845.

[51] Int. Cl.[5] ..... A63B 71/14

[52] U.S. Cl. ..... 2/19; 2/161 A; 2/162

[58] Field of Search ..... 2/162, 19, 161 A

[56] References Cited

U.S. PATENT DOCUMENTS

| | | | |
|---|---|---|---|
| 811,389 | 1/1906 | Ferry | 2/19 |
| 1,602,027 | 10/1926 | Kennedy | 2/19 |
| 1,790,381 | 1/1931 | Keller | 2/20 X |
| 2,558,544 | 6/1951 | Delsalle | 2/19 |
| 3,994,024 | 11/1976 | Bates | 2/19 |
| 4,065,813 | 1/1978 | Hudson | 2/19 |
| 4,400,831 | 3/1983 | Rietz | 2/161 A |
| 4,411,024 | 10/1983 | Hayes | 2/161 A X |
| 4,497,073 | 2/1985 | Deutsch | 2/162 X |
| 4,502,688 | 3/1985 | Papp | 2/161 A X |
| 4,541,127 | 9/1985 | Gould | 2/19 |
| 4,630,318 | 12/1986 | Aoki | 2/161 R X |
| 4,651,345 | 3/1987 | Latina | 2/19 |
| 4,677,698 | 7/1987 | Angas | 2/19 X |
| 4,891,845 | 1/1990 | Hayes | 2/19 |
| 4,937,882 | 7/1990 | Hayes | 2/19 |

*Primary Examiner*—Werner H. Schroeder
*Assistant Examiner*—Sara M. Current
*Attorney, Agent, or Firm*—Irving M. Weiner; Robert M. Petrik; Pamela S. Burt

[57] ABSTRACT

A support portion for a baseball glove which may be integrally formed with the glove or separately attached thereto, the support portion being attached to a back wall of the glove so as to extend a distance above and below the free lower edge of the front wall of the glove sufficient to cover a lower back portion of the user's hand, the back of the user's wrist, and a back portion of the user's forearm. The support portion includes a securing member adapted to wrap around a user's arm below the wrist. In use, the support portion serves the dual purposes of supporting the user's wrist against injurious bending and imparting a natural control and feel to the glove. The support portion may include indentations on each side to provide greater lateral and forward hand and wrist flexibility while still providing support for the backward motion of the hand and wrist. The strap portion may include an elastic member to provide a better fit on various sized user's wrists.

19 Claims, 4 Drawing Sheets

FIG 1
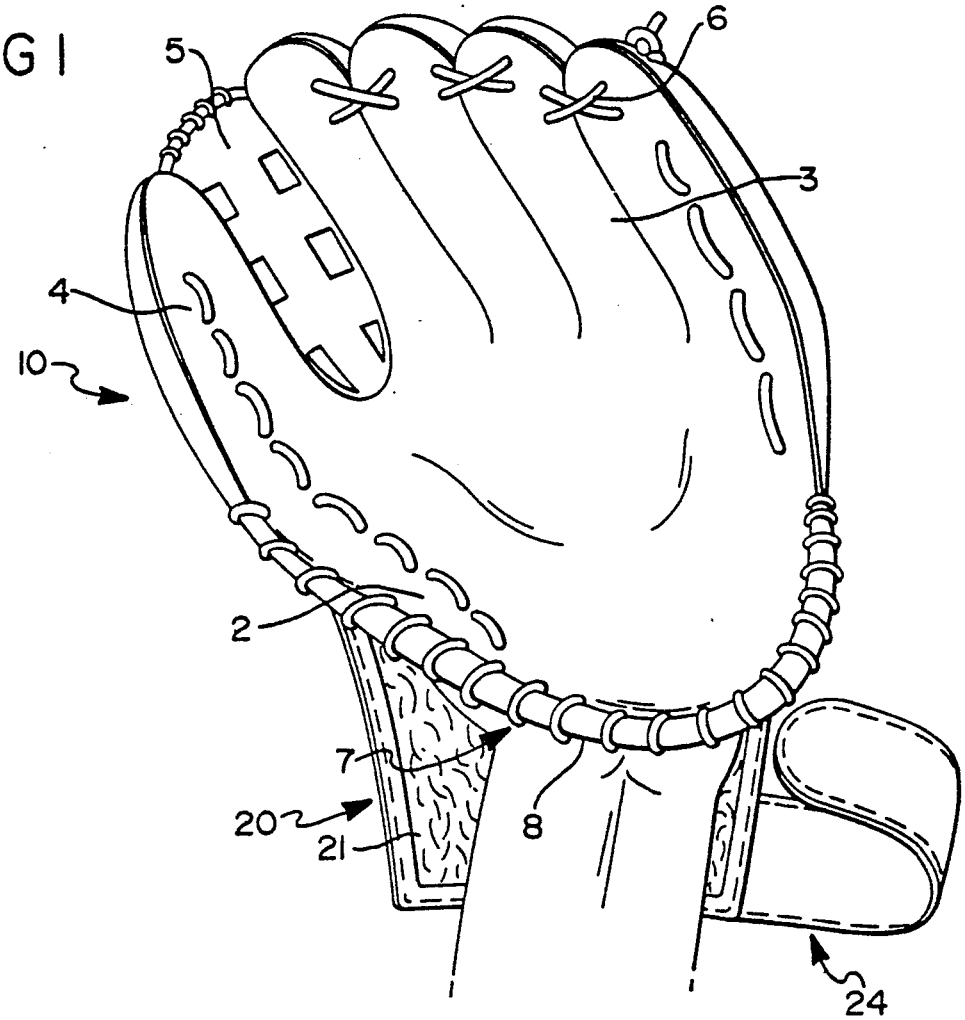
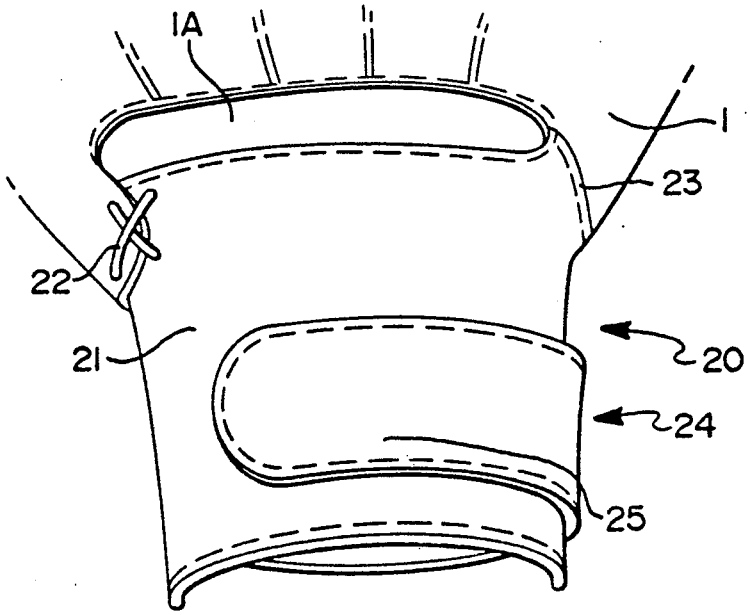
FIG 2

BASEBALL GLOVES AND ATTACHMENTS THEREFOR, AND METHODS OF CONSTRUCTING AND UTILIZING SAME

CROSS REFERENCES TO RELATED APPLICATIONS

This is a continuation-in-part of U.S. Ser. No. 275,951, filed Nov. 25, 1988, now U.S. Pat. No. 4,937,882, which is a continuation-in-part of application Ser. No. 158,647, filed Feb. 22, 1988 now U.S. Pat. No. 4,891,84.

BACKGROUND OF THE INVENTION

1. Field of the Invention

The present invention relates generally to support attachments for baseball gloves, and to baseball gloves integrally provided with support portions. More particularly, the invention relates to a support portion, for attachment to or integral formation with a conventional baseball glove, which not only supports the user's wrist, but also operatively cooperates with portions of the user's hand, wrist and forearm so as to impart controlling movements therefrom to the baseball glove disposed on the user's hand.

The terminology "baseball glove" as employed herein is intended to connote any of a variety of conventional baseball gloves or mitts comprising front and back walls joined together at upper and side portions thereof and defining at the lower portions thereof a hand insertion opening. Typically, such baseball gloves have the front and back walls thereof joined together to define a thumb portion separate from a fingers portion, with an intermediate bridge or pocket portion connected between the thumb and fingers portions.

A variety of different baseball glove constructions intended for different playing positions are also intended to be covered by the terminology "baseball glove." In the case of gloves to be used by fielders, the fingers portion of the baseball glove often has the front and back walls stitched together in a manner which forms a plurality of finger stalls. In the case of catchers' mitts, the fingers portion of the glove may or may not be formed with separate finger stalls; and in the case of first base gloves or mitts, the fingers portion is often defined without separate finger stalls.

The above-described conventional baseball gloves or mitts typically conform to various professional baseball standards for size, pockets, adjustments and padding and are fabricated of leather such as top grain cow hide which is treated and tanned to meet color and/or texture regulations. The gloves may or may not be treated with a water repelling substance, as desired.

2. Description of the Relevant Art

One of the major problems attendant conventional baseball gloves is the lack of support of one of the most vulnerable parts of the baseball player's body, his or her wrist. The wrist is particularly vulnerable due to the added weight of the baseball glove itself; and also due to the force of a ball caught in the glove, which is often sufficient to cause the hand to bend backwards sharply at the wrist. When subjected to this sudden stress, the wrist is highly susceptible to spraining or other injury. At the same time, the player is quite likely to lose the ball he is attempting to catch.

Another problem attendant conventional baseball gloves relates to control. The unnatural heaviness and thick padding of the glove on the player's hand can often lead to an awkward unwieldiness of the gloved hand during play. There has thus developed a desideratum for a glove construction or attachment which is capable of making the rather heavy and sometimes unwieldy glove a more integral part of the user's catching arm, wrist and hand movements.

Illustrative of known glove constructions and attachments therefor which support and/or cooperate with the user's wrist are those disclosed in the below-discussed U.S. Patents.

U.S. Pat. No. 811,389 issued in 1906 to Ferry entitled "BALL PLAYER'S MITT" discloses a catcher's mitt having a wrist-band secured to the palm or front wall, as well as side portions of the back wall, of the mitt. The principal supporting portion of the wrist-band extends along the front or palm side of the user's wrist, while the back of the user's wrist is left essentially unprotected against backwards bending.

U.S. Pat. No. 4,400,831 issued in 1983 to Rietz discloses a water skiing glove having a length of palm side strapping extending from an upper fingers portion of the glove to a lower wrist portion thereof. The palm strapping is connected to a wrist strapping adapted to be wrapped about the user's forearm. The palm strapping is particularly suited for alleviating arm-straining forces while waterskiing, and is not intended to protect the back of the hand, wrist and forearm of a user engaged in baseball playing activity.

U.S. Pat. No. 4,651,345 issued in 1987 to Latina entitled "WRIST STRAP CONSTRUCTION FOR A BASEBALL GLOVE" discloses a wrist strap secured at its inner end to the glove by a web of elastic material and having at its outer end a fastening element which cooperates with a fastening element on the back of the glove itself. Because the wrist strap extends only across the lower portions of the back wall of the glove, it affords little protection against backwards bending of the user's wrist when catching a ball.

Each of the above-described known constructions fails to overcome the aforesaid support and control problems attendant conventional baseball gloves.

The present invention effectively overcomes such problems by providing not only a firm support against backward bending of the hand about the user's wrist, but also enhanced control capabilities enabling the user's gloved hand to become a more natural part of the movements of the catching arm.

SUMMARY OF THE INVENTION

The present invention provides an apparatus for imparting hand, wrist and arm control to a baseball glove, comprising first means integrally attached to a back wall of the glove so as to extend a distance above and below a lowermost free edge of a front wall of the glove which is sufficient to cover and support at least back portions of a user's hand, wrist and forearm, and second means for securing the first means in position adjacent at least back portions of the user's hand, wrist and forearm. The first and second means operatively cooperate with each other and with the baseball glove to permit flexing of a user's hand and wrist beneath the first means while the first means is disposed sufficiently close to the back of the user's hand, wrist and forearm to support same and impart controlling movements from the user's hand, wrist and forearm to the baseball glove.

Preferably, the first means comprises a support piece and the second means comprises a strap member attached to the support piece and having a length sufficient to wrap around the user's forearm adjacent the wrist and overlap on an outer surface portion of the support piece. The support piece and strap member are desirably fabricated of a bendable but non-stretchable material, such as the same leather used to fabricate the body of the glove.

The present invention also provides a support and control attachment for a baseball glove wherein an upper portion of the support piece is adapted to be stitched or otherwise joined to a lower portion of the back wall of the glove.

It is an object of the present invention to provide a support portion for a baseball glove which covers, supports and operatively cooperates with back portions of the user's hand, wrist and forearm not only to protect the wrist from injury but also to afford the user greater control of the gloved hand during play. The support portion may be provided as part of an integral baseball glove construction, or alternatively may be provided in the form of an attachment adapted to be stitched or otherwise joined to an existing baseball glove.

A further object of the invention is to enhance the user's ability to control his/her catching arm and gloved hand by enabling hand, wrist and forearm movements of the player to be imparted to the baseball glove.

Yet another object of the invention is to provide a support portion or attachment for a baseball glove which is fabricated of the same leather material as the glove itself; thus enhancing the aesthetics of the glove, meeting various regulations concerning glove material, and imparting desirable flexibility and firm support characteristics to the support portion.

The above and further objects, details and advantages of the present invention will become apparent from the following detailed description of preferred embodiments thereof, when read in conjunction with the accompanying drawings.

BRIEF DESCRIPTION OF THE DRAWINGS

FIG. 1 is a front perspective view of a baseball glove provided with a support portion in accordance with the present invention, the glove being disposed on a user's hand without the strap member being fastened in place.

FIG. 2 is a view of the back of the baseball glove with support portion of FIG. 1, showing the strap member fastened in place.

DETAILED DESCRIPTION OF PREFERRED EMBODIMENTS

Figure 3:
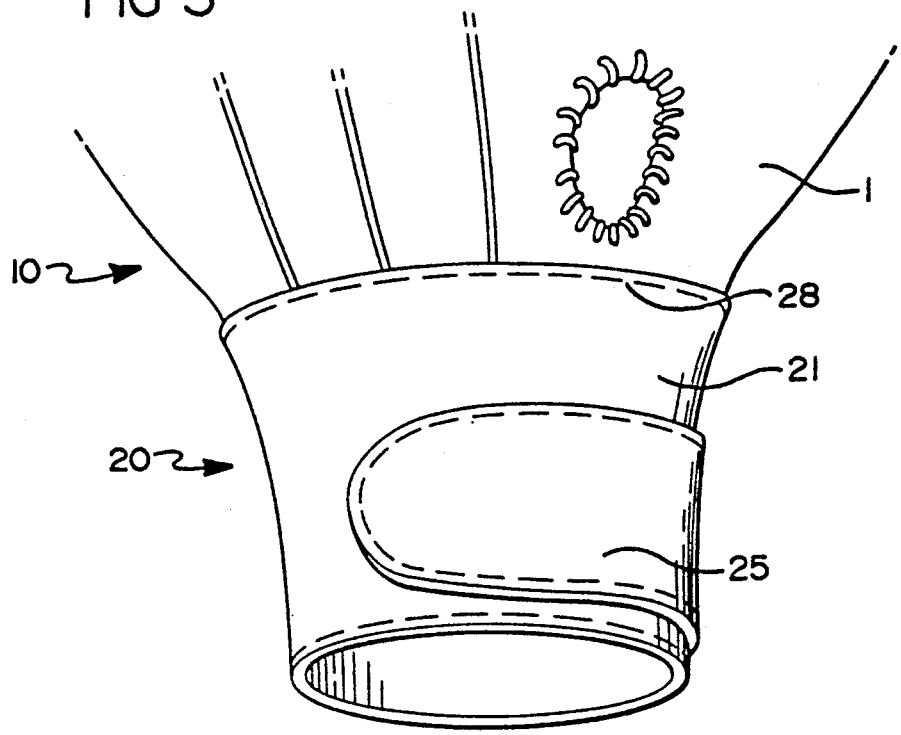
FIG. 3 is a view of the back of a baseball glove showing a support portion according to the invention having its upper back edge stitched to a lower edge of the back wall of the glove.

With reference to FIGS. 1 and 2, there is shown a baseball glove 10 provided with a support portion 20 in accordance with the invention. The baseball glove 10 is of a conventional construction for a fielder's glove, for example, and includes a back wall 1 (FIG. 2) and a front wall 2 (FIG. 1) joined together to define a fingers portion including a plurality of finger stalls 3 and a separate thumb portion 4. The fingers portion and thumb portion 4 are joined together by a bridging portion or pocket 5. It is contemplated that the baseball glove 10 is constructed to conform to various professional baseball standards for size, pockets, adjustments and padding and is fabricated of leather such as top grain cow hide which is treated and tanned to meet color and/or texture regulations. Glove 10 may or may not be treated with a water repelling substance, as desired. As shown, glove 10 may also include various stitched portions 6, of rawhide for example, for supplying necessary structural features such as the joining together of the outer ends of finger stalls 3, for example.

As shown in FIG. 1, the glove 10 includes a lower hand-insertion opening 7 defined on the front side by the lower free edge of front wall 2 and on the back side by the downwardly-extending back support piece 21 of support portion 20.

As shown in FIG. 2, the support piece 21 of support portion 20 may be integrally stitched to lower sections of back wall 1 of glove 10 on either side of a back wall opening 1A. By way of example, a left upper portion of support piece 21 may be cross-stitched at 22 (using rawhide, for example) to a left lower section of back wall 1, while a right upper portion of support piece 21 may be attached to a right lower section of back wall 1 by running stitching 23. It is to be understood, however, that support portion 20 may be attached to the lower section of a back wall of a baseball glove of virtually any known construction, and to this end the upper portion(s) of support piece 21 may be shaped as necessary for attachment to a particular glove, and any suitable means may be employed for joining the glove with support piece 21. If desired, the back wall 1 of the glove may be integrally formed with support piece 21 during manufacture.

Preferably, support piece 21 is fabricated of leather such as top grain cowhide, which will impart the necessary substantially bendable and non-stretchable characteristics thereto. Also, the support piece 21 may desirably be fabricated of the same leather material employed in fabricating glove 10, and may be treated with water repellent if desired. As shown in FIG. 1, the inside surface of support piece 20 is lined with a padding material, which may comprise, for example, a layer of fur material, velour, etc., which will comfortably contact the user's skin without chaffing.

The support piece 21 extends a distance above and below the lower free end 8 of front wall 2 sufficient to cover and support a lower portion of the back side of the user's hand, the back side of the user's wrist, and an upper portion of the back side of the user's forearm, as will be discussed in greater detail hereinbelow. By way of example, the overall length of support piece 21 from the upper to the lower edge thereof may be approximately 3" to 4".

Extending from a lower side edge portion of support piece 21 is a securing means in the form of a strap member 24 which may be stitched or otherwise secured to support piece 21. Preferably, strap 24 is fabricated of the same leather material as support piece 21 to provide durability secure fastening and an aesthetically pleasing appearance. If desired, strap 24 may have a double-walled leather construction. The strap 24 has a length which is sufficient to permit it to be wrapped around the user's forearm adjacent to and below the wrist area and to overlap a substantial extent on the outer surface of support piece 21, as shown in FIG. 2.

Figure 4:
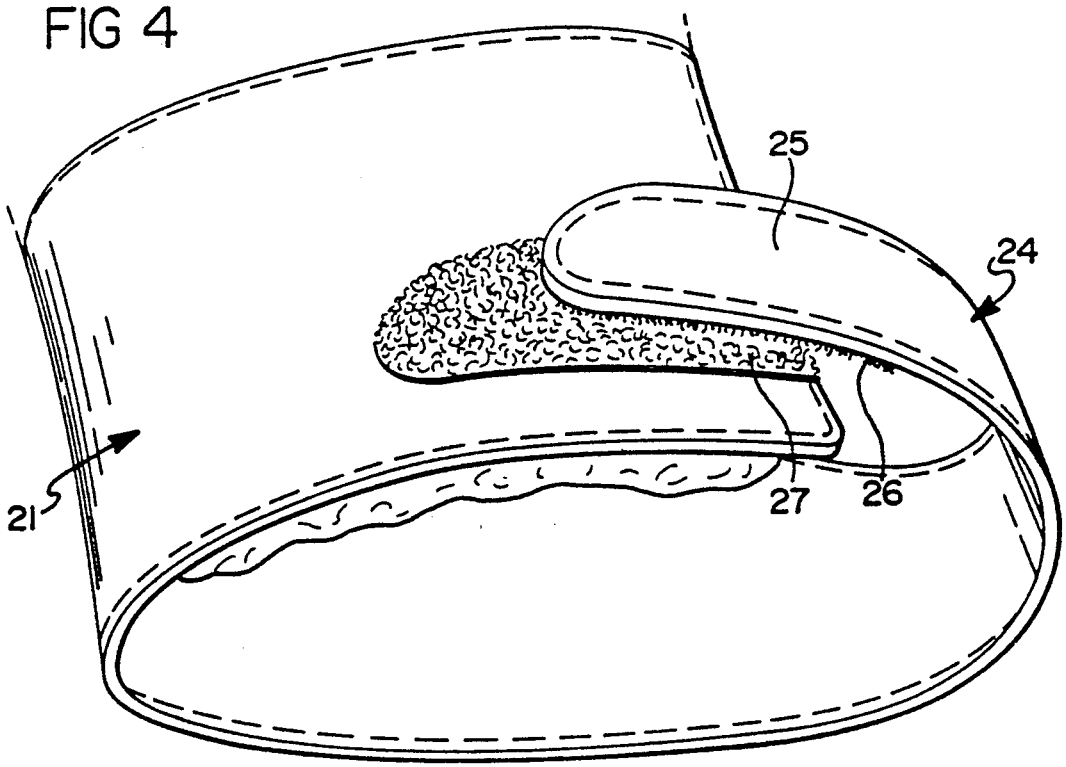
FIG. 4 is a perspective view of the support portion of FIG. 3, showing the details of a preferred fastening means.

By way of example, the inner surface of overlapping portion 25 of strap 24 may be provided with a first fastening member which interengages with a second fastening member provided on an outer surface of support piece 21. As best shown in FIG. 4, the first and second fastening members 26, 27 may desirably comprise hook and pile type fastening members such as "Velcro". These fastening members are long enough to permit adjustability in engagement therebetween so that strap 24 may be snugly wrapped around forearms of varying sizes.

The present invention is not limited to the above-described details of construction of strap 24 and fastening members 26, 27, and it is contemplated that other suitable securing means for support piece 21 may be employed as desired.

In use, the baseball glove 10 is fitted onto the user's hand in a conventional manner, with strap 24 extending freely as shown in FIG. 1. The strap 24 is then wrapped snugly, but comfortably, around the user's forearm adjacent to and below the wrist, and is fastened in overlapping position on support piece 21 as shown in FIG. 2. The construction of strap 24 and fastening members 26, 27 permits convenient one-handed fastening of strap 24 in position.

With the glove and support portion thus operably disposed on the user, it will be understood with reference to FIGS. 1 and 2 that support piece 21 will be securely positioned adjacent back side portions of the user's hand, wrist and forearm. More specifically, support piece 21 will extend along the back of the user's hand and forearm from a lower hand portion above the wrist, along the wrist, and along an upper portion of the user's forearm.

As thus operably disposed, the support piece 21 permits flexing of a user's hand about the wrist while providing firm support against backward bending of the hand at the wrist. Accordingly, the user's wrist will be well supported against backward bending during catching operations. The support piece 21 will also serve to support the user's wrist during forward bending movements, i.e., the snug fit of support piece 21 against the back of the wrist afforded by the securing strap 24 will assist in limiting any unnatural forward flexing of the wrist.

Also, because support piece 21 extends in operable contact from a lower hand portion to an upper forearm portion of the user, the support piece 21 provides a unique control and feel for the baseball glove 10. Essentially, support piece 21 will bend with and closely follow the user's hand, wrist and forearm movements during play. The integral attachment of support piece 21 to glove 10 permits these movements to be imparted to glove 10 in a manner which enables glove 10 to become a more integral part of the user's hand, wrist and forearm movements. The unwieldiness often caused by the unnatural weight and bulkiness of glove 10 can thus be substantially overcome as the glove 10 becomes a more natural extension of the user's catching arm.

With reference to FIGS. 3 and 4, a support portion 20 is shown as attached having the upper section thereof secured to the lower section of a back wall 1 of a glove 10 by a substantially horizontal line of running stitches 28. Further, the strap 24 is shown as being integrally formed with support piece 21. In other respects, support piece 21 shown in FIGS. 3 and 4 is substantially the same as described hereinabove with respect to FIGS. 1 and 2, i.e., it is adapted to extend a distance above and below the lower edge of the front wall of glove 10 sufficient to cover and support the back sides of a lower portion of the user's hand, the wrist, and an upper portion of the forearm (as shown in FIG. 1 with respect to the first embodiment).

It will be understood from the foregoing that the support piece 21, strap 24 and fastening means 26, 27 may be integrally provided as part of any conventional type of baseball glove, or alternatively an assembly of such parts may comprise a separate attachment adapted to be readily joined to an existing baseball glove.

Figure 5:
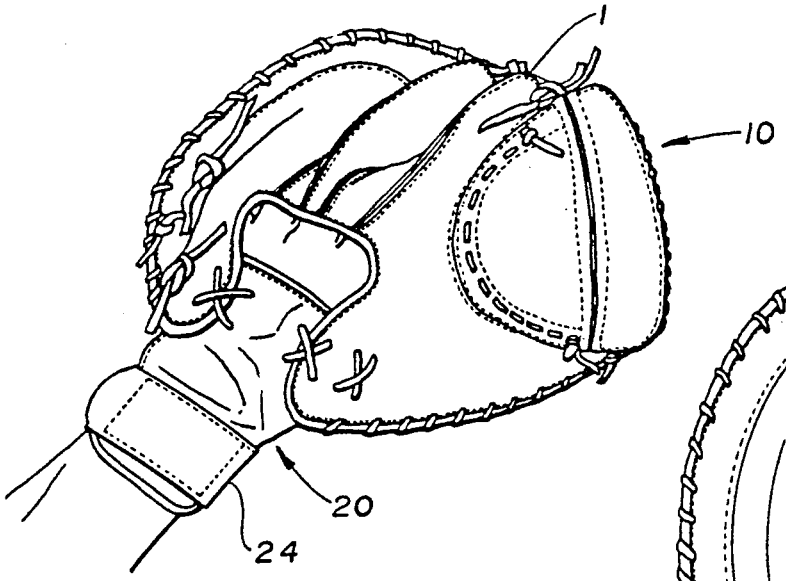
FIG. 5 is a back perspective view of a catcher's mitt having the support portion according to the invention operably positioned on a user's hand, wrist and forearm.
Figure 6:
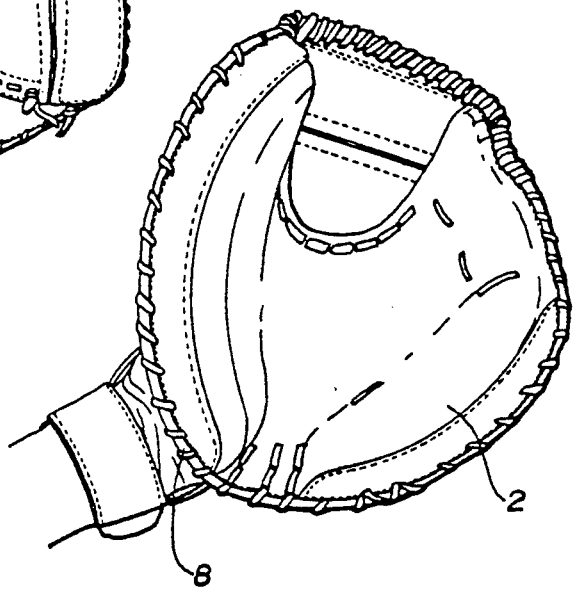
FIG. 6 is a front perspective view of the catcher's mitt with support portion of FIG. 5.

With reference to FIGS. 5 and 6, there is shown a support portion 20 in accordance with the invention as applied to a catcher's mitt, the upper side edge portions of support piece 21 being attached to the back wall 1 of the mitt by rawhide cross stitching. The details of construction of support portion 20 including support piece 21, strap 24 and the fastening means are substantially the same as discussed in detail hereinabove.

Figure 7:
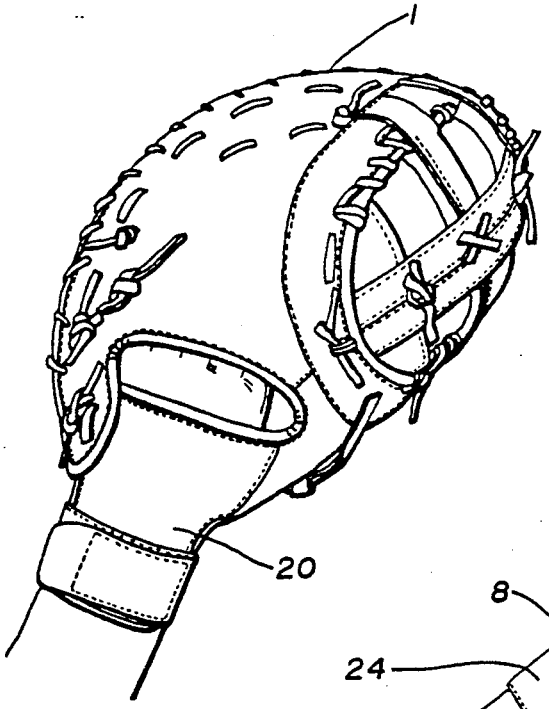
FIG. 7 is a back perspective view of a first base glove having the support portion according to the invention operably positioned on a user's hand, wrist and forearm.
Figure 8:
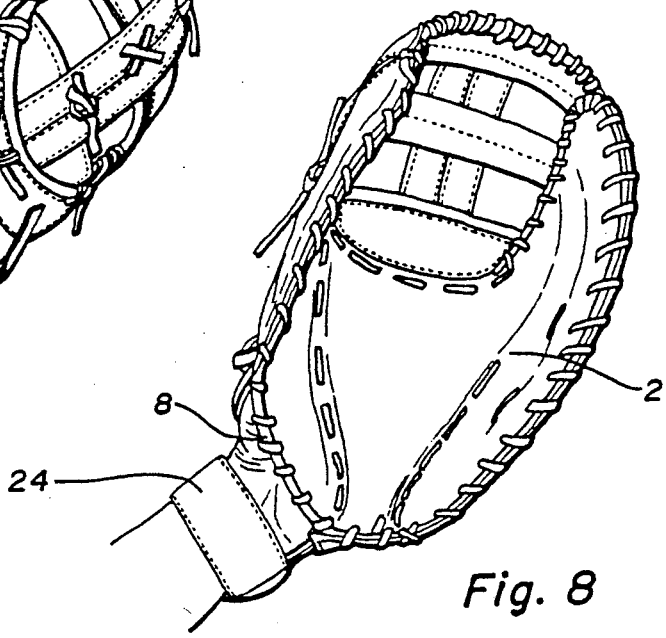
FIG. 8 is a front perspective view of the first base glove with support portion of FIG. 7.

As shown in FIGS. 7 and 8, the support portion 20 in accordance with the invention may also be readily applied to a first base glove or mitt by rawhide cross stitching, running stitches, or a combination thereof. The details of construction of support piece 21, strap 24 and the fastening means are substantially the same as discussed in detail hereinabove.

It will be understood from the foregoing that the support piece 21 in accordance with the invention may be attached at upper portions and side portions thereof in any desirable fashion to a lower section or sections of the back wall 1 of a conventional glove, provided that once it is attached support piece 21 extends a distance above and below the free lower end 8 of the front wall 2 of the glove sufficient to cover back portions of the user's hand, wrist and forearm. Further, the support piece 21 has a length suitable to permit strap 24 attached to the lower portion thereof to be wrapped around the user's forearm adjacent to and below the user's wrist. The width of support piece 21 is preferably sufficient, at the middle and lower portions thereof, to wrap entirely across the back side of the user's wrist and forearm in an operable position.

Figure 10:
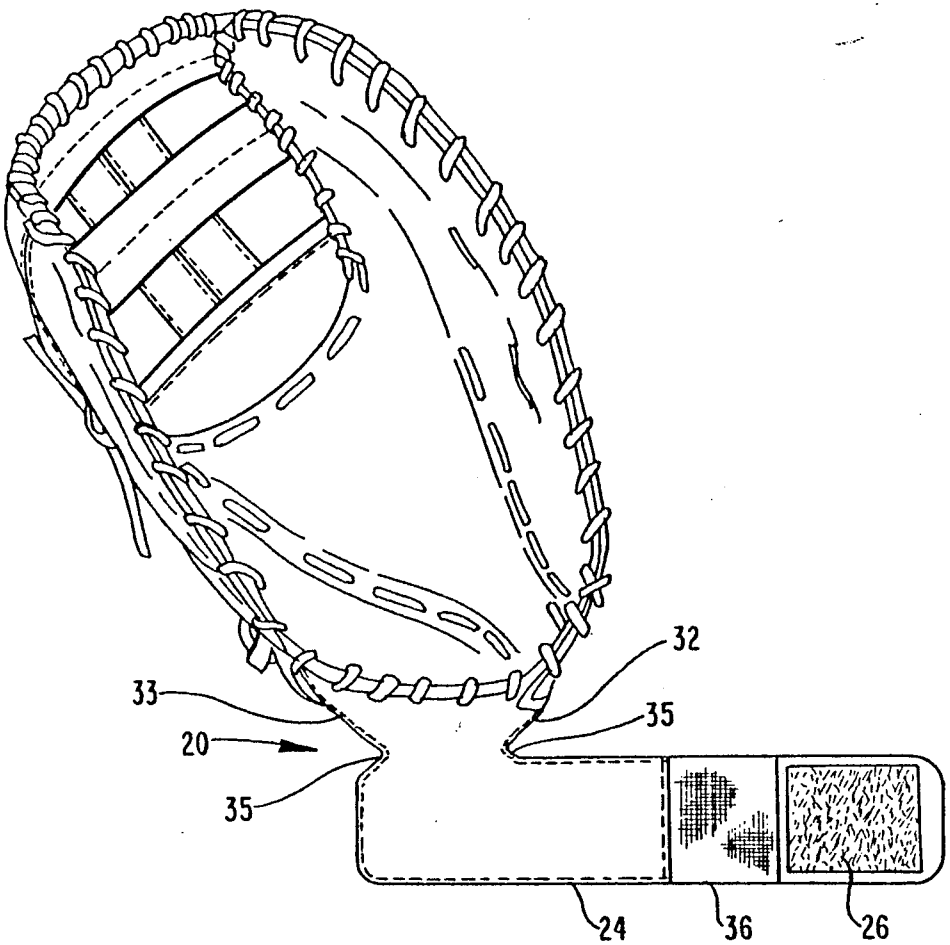
FIG. 10 is a front perspective view of the glove of FIG. 9 showing the strap open.
Figure 9:
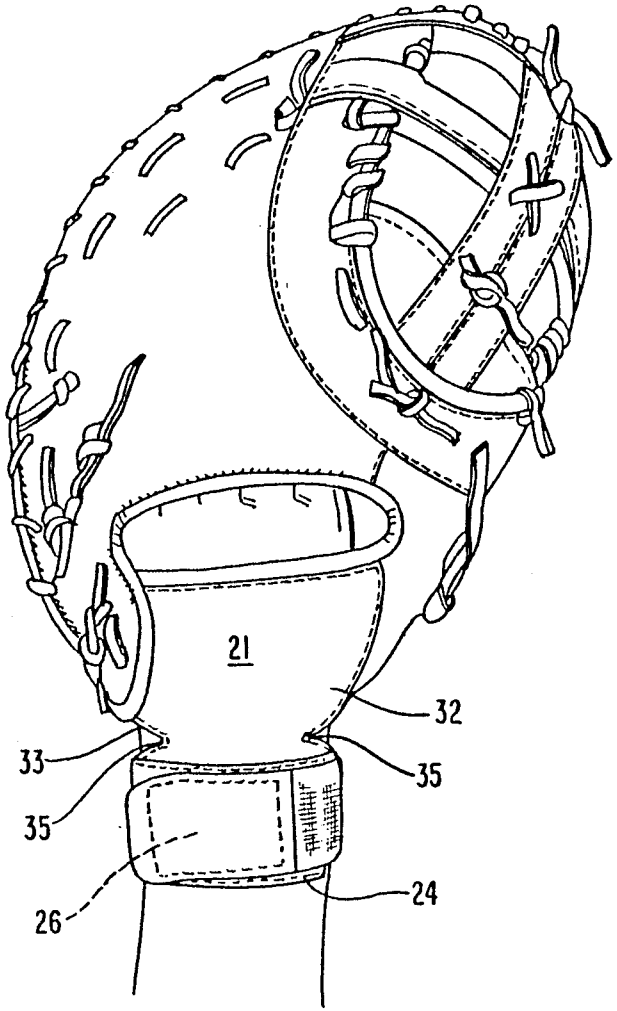
FIG. 9 is a back perspective view of the glove on a user's hand, the glove including an elastic portion and increased flexibility means.

Another embodiment of the present invention, as best seen in FIGS. 9 and 10, shows that support portion 20 may also include means to provide greater wrist flexibility for the user. This is accomplished by providing indents 35 on the side 32, 33 of support piece 21.

This arrangement allows the support piece 21 to provide firm support against backward bending of the hand at the wrist while permitting the user greater flexibility in lateral and forward motions of the hand and wrist.

To provide a better fit on the wrist, strap 24 may be provided with an elastic portion 36. This portion 36 is preferably provided adjacent the fastening member 26 to provide a greater range of comfort for people with various sized arms or wrists. However, portion 36 may be located at any point of strap 24. Preferably, elastic portion 36 is of such size to permit sufficient stretch along strap 24. Elastic portion 36 is fastened to strap 24 by any of the well known means for connecting such materials.

While there have been described hereinabove what are at present considered to be the preferred embodiments of the invention, it will be understood that various modifications may be made therein without departing from the spirit and scope of the invention. The present embodiments are therefore to be considered in all respects as illustrative, and not restrictive. The scope of the invention is indicated by the appended claims rather than by the foregoing description.

I claim:

1. An apparatus for imparting hand, wrist and arm control to a baseball glove, comprising:

first means integrally attached to a back wall of said baseball glove so as to extend a distance above and below a lowermost free edge of a front wall of said baseball glove which is sufficient to cover and support at least back portions of a user's hand, wrist and forearm;

second means for securing said first means in position adjacent at least back portions of the user's hand, wrist and forearm;

a third means on said first means for providing wrist flexibility; and said first, second and third means operatively cooperating with each other and with said baseball glove to permit flexing of a user's hand and wrist beneath said first means while said first means is disposed sufficiently close to the back of the user's hand, wrist and forearm to support same and impart controlling movements from the user's hand, wrist and forearm to said baseball glove.

2. An apparatus according to claim 1, wherein:

said first means comprises a support piece including two side and a lower portion fabricated of a substantially bendable and non-stretchable material; and said second means comprises a securing member connected with said lower portion of said support piece and adapted to be disposed around a portion of the user's forearm proximal and below the user's wrist; and said third means comprises indentations on each side of said support piece.

3. An apparatus according to claim 2, wherein:

said securing member comprises a strap member attached to said support piece and having a sufficient length to wrap around the user's forearm and overlap on an outer surface portion of said support piece; and means are provided for fastening said overlapping portion of said strap member to said outer surface portion of said support piece.

4. An apparatus according to claim 3, wherein:

said support piece is attached to said back wall of said baseball glove by rawhide stitching.

5. An apparatus according to claim 4, wherein:

said baseball glove, said support piece and said securing member are fabricated substantially of leather;

said securing member includes a portion of elastic material; and said fastening means comprises a first fastening member provided on an inner surface of said overlapping portion of said strap member and a second fastening member provided on said outer surface portion of said support piece, said first and second fastening members being interengageable in an adjustable manner.

6. In a baseball glove comprising a front or palm wall having a back wall connected thereto to define a thumb portion, a fingers portion, and a lower hand-insertion opening of said glove, the improvement wherein:

a wrist support portion extends from a lower section of said back wall, said wrist support portion comprising a support piece integrally attached to said back wall so as to extend a distance above and below the lowermost free edge of said front wall which is sufficient to cover and support at least back portions of a user's hand, wrist and forearm;

indentations on either side of said wrist support portion to provide hand and wrist flexibility;

means are provided for securing said support piece in position adjacent at least back portions of a user's hand, wrist and forearm; and said securing means is integrally attached to said support piece.

7. A baseball glove according to claim 6, wherein:

said support piece is fabricated of a substantially bendable and non-stretchable material; and said securing means comprises a strap member adapted to be wrapped around a user's forearm proximal the user's wrist.

8. A baseball glove according to claim 7, wherein:

said strap member is integrally attached to a lower side portion of said support piece and is of a sufficient length to wrap around the user's forearm and overlap on an outer surface portion of said support piece;

a portion of said strap member comprises elastic material; and means are provided for fastening said overlapping portion of said strap member to said outer surface portion of said support piece.

9. A baseball glove according to claim 8, wherein:

said fastening means comprises a first fastening member provided on an inner surface of said overlapping portion of said strap member and a second fastening member provided on said outer surface portion of said support piece, said first and second fastening members being interengageable in an adjustable manner.

10. A baseball glove according to claim 9, wherein:

said strap member is fabricated of a substantially bendable and non-stretchable material;

an inner surface of said support piece is lined with a padding material; and said first and second fastening members comprise interengageable hook and pile type members.

11. A baseball glove according to claim 6, wherein:

said baseball glove comprises a fielder's glove; and said front and back walls of said glove are connected together in said fingers portion to define a plurality of finger stalls.

12. A baseball glove according to claim 6, wherein:

said means for securing said support piece includes an elastic portion.

13. A support and control attachment for a baseball glove, comprising:

a support piece adapted to be integrally attached to a back wall of said baseball glove so as to extend a distance above and below a lowermost free edge of a front wall of said baseball glove sufficient to cover and support at least back portions of a user's hand, wrist and forearm;

means for securing said support piece in position adjacent at least back portions of a user's wrist and forearm and including an elastic material; and said securing means being integrally attached to said support piece.

14. A wrist support attachment according to claim 13, wherein:

said support piece is fabricated of a substantially bendable and non-stretchable material and is attached to said back wall of said baseball glove by stitching.

15. A wrist support attachment according to claim 14, wherein:

an upper edge of said support piece is adapted to be stitched to a lower portion of said back wall of said baseball glove.

16. A wrist support attachment according to claim 14, wherein:

a pair of upper side edge portions of said support piece are adapted to be respectively stitched to a pair of lower side edge portions of said back wall of said baseball glove.

17. A wrist support attachment according to claim 14, wherein:

said securing means comprises a strap member adapted to be wrapped around a user's forearm proximal the user's wrist;

said strap member has one end thereof extending from a lower side portion of said support piece and is of a sufficient length to wrap around the user's forearm such that an opposite end portion thereof overlaps on an outer surface portion of said support piece;

means are provided for fastening said overlapping portion of said strap member to said outer surface portion of said support piece; and said elastic material is provided adjacent the inner edge of said means for fastening.

18. A wrist support attachment according to claim 17, wherein:

said strap member is fabricated of a substantially bendable material, and an inner surface of said support piece is lined with a padding material.

19. A wrist support attachment according to claim 14, wherein:

said support piece extends from said back wall a distance of at least three inches.

* * * * *